US008570312B2

(12) United States Patent
Ogata et al.

(10) Patent No.: US 8,570,312 B2
(45) Date of Patent: Oct. 29, 2013

(54) PLASMA DISPLAY DEVICE

(75) Inventors: Kunihiko Ogata, Miyazaki (JP); Yoshikazu Kanazawa, Miyazaki (JP)

(73) Assignee: Hitachi Consumer Electronics Co., Ltd., Tokyo (JP)

( * ) Notice: Subject to any disclaimer, the term of this patent is extended or adjusted under 35 U.S.C. 154(b) by 775 days.

(21) Appl. No.: 12/298,377

(22) PCT Filed: Jul. 20, 2006

(86) PCT No.: PCT/JP2006/314431

§ 371 (c)(1),
(2), (4) Date: Mar. 24, 2009

(87) PCT Pub. No.: WO2008/010288

PCT Pub. Date: Jan. 24, 2008

(65) Prior Publication Data

US 2009/0201279 A1 Aug. 13, 2009

(51) Int. Cl.
*G09G 5/00* (2006.01)

(52) U.S. Cl.
USPC ..... 345/211; 345/204; 345/60

(58) Field of Classification Search
USPC ..... 345/211, 60–72, 204, 205; 315/169.4
See application file for complete search history.

(56) References Cited

U.S. PATENT DOCUMENTS 7,755,893 B2 7/2010 Yanagawa et al.
2003/0141576 A1* 7/2003 Kawada et al. ..... 257/666
2004/0201552 A1* 10/2004 Onozawa et al. ..... 345/60
2005/0230818 A1* 10/2005 Ohno et al. ..... 257/707
2007/0268213 A1* 11/2007 Urano et al. ..... 345/60
2009/0009047 A1* 1/2009 Yanagawa et al. ..... 313/46
2009/0079722 A1* 3/2009 Onozawa et al. ..... 345/212

FOREIGN PATENT DOCUMENTS

JP 2003-216054 7/2003
JP 2007-171336 7/2007
WO WO 2006/098365 A1 9/2006

OTHER PUBLICATIONS

Japanese Office Action, with partial English translation, issued in Japanese Patent Application No. 2008-525766, mailed Sep. 21, 2010.
English translation of the International Preliminary Report on Patentability and Written Opinion of the International Searching Authority, issued in corresponding International Patent Application No. PCT/JP2006/314431, mailed Jan. 29, 2009.

* cited by examiner

*Primary Examiner* — Stephen Sherman
(74) *Attorney, Agent, or Firm* — McDermott Will & Emery LLP

(57) ABSTRACT

Provided is a plasma display device including a plasma display panel having a plurality of first and second electrodes extending in the horizontal direction and a plurality of third electrodes extending in the vertical direction, and first electrode driving circuit substrates to supply voltage to the first electrodes, in which center lines in the vertical direction of the first electrode driving circuit substrates are below a center line in the vertical direction of the plasma display panel.

8 Claims, 7 Drawing Sheets

PLASMA DISPLAY DEVICE

RELATED APPLICATIONS

This application is the U.S. National Phase under 35 U.S.C. §371 of International Application No. PCT/JP2006/314431, filed on Jul. 20, 2006, the disclosure of which Application is incorporated by reference herein.

TECHNICAL FIELD

The present invention relates to plasma display devices.

BACKGROUND ART

A plasma display panel is a component in which a mixed gas for electric discharge use such as neon (Ne), xenon (Xe) or the like is filled in a discharge space sandwiched between two sheets of glass substrates, an electric discharge is allowed to occur by applying a voltage greater than that necessary to initiate the electric discharge between electrodes and a phosphor formed above a substrate is excited to emit light by ultra violet rays generated by the electric discharge so as to serve as a display. The plasma display device is expected as a display device capable of realizing a future full-color large screen display device owing to the superiority over a display area, a display capacity, and response characteristics, etc. In addition to that, a large screen of 40 inch to 60 inch or more in size is now realized as a direct view type display, which cannot be realized with other devices. The plasma display device has a disadvantage of occurring deterioration of electronic parts due to heat when a temperature in the device gets high.

SUMMARY OF THE INVENTION

An object of the present invention is to provide a plasma display device capable of preventing deterioration of electronic parts due to heat.

According to a point of view of the present invention, provided is a plasma display device which includes a plasma display panel having a plurality of first and second electrodes extending in the horizontal direction and a plurality of third electrodes extending in the vertical direction; and first electrode driving circuit substrates supplying voltage to the first electrodes, in which the vertical center lines of the first electrode driving circuit substrates are below the vertical center line of the plasma display panel.

According to another point of view of the present invention, provided is a plasma display device which includes a plasma display panel having a plurality of first and second electrodes extending in the horizontal direction and a plurality of third electrodes extending in the vertical direction; and first electrode driving circuit substrates supplying a voltage to the first electrodes, in which the distance from the upper ends of the first electrode driving circuit substrates to the upper end of the plasma display panel is longer than the distance from the lower ends of the first electrode driving circuit substrates to the lower end of the plasma display panel.

DETAILED DESCRIPTION OF THE PREFERRED EMBODIMENTS

Figure 5:
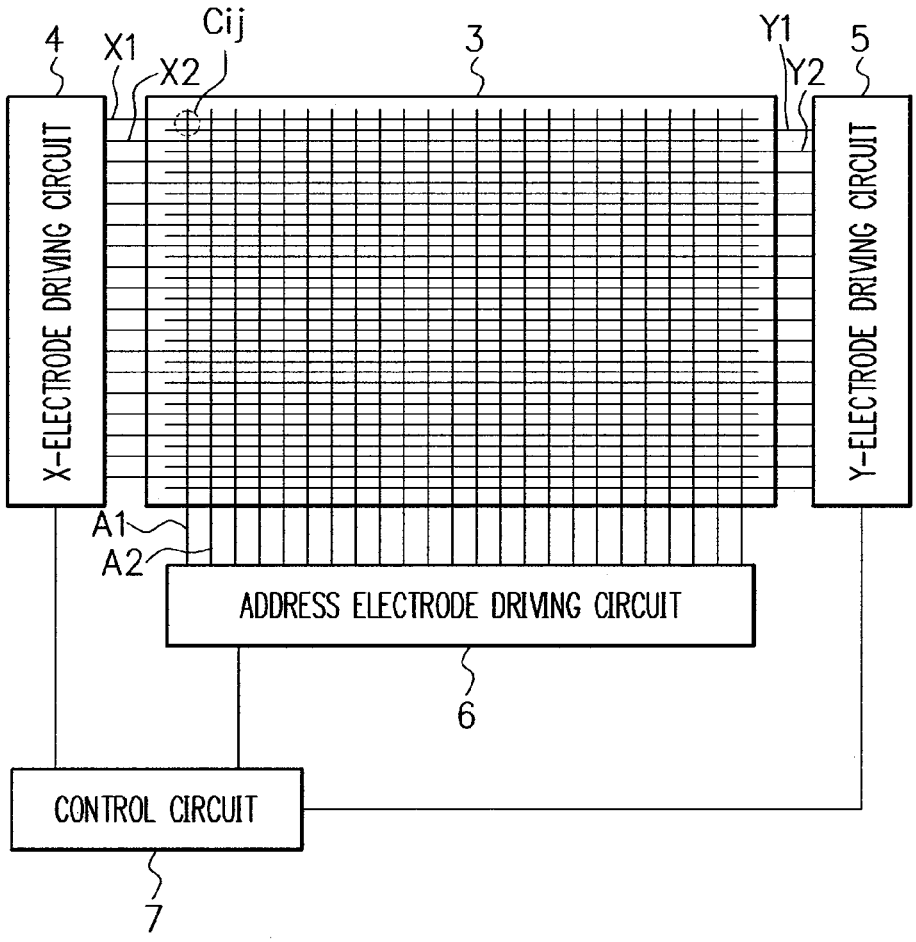
FIG. 5 is a view of a configuration example of a plasma display device.

FIG. 5 is a view depicting a configuration example of a plasma display device according to an embodiment of the present invention. A control circuit 7 controls an X-electrode driving circuit 4, a Y-electrode driving circuit 5 and an address electrode driving circuit 6. The X-electrode driving circuit 4 supplies a prescribed voltage to a plurality of X-electrodes X1, X2, . . . . Hereinafter, each of the X-electrodes X1, X2, . . . , or a generic of the X-electrodes is referred to as an X-electrode Xi, where "i" means a subscript. The Y-electrode driving circuit 5 supplies a prescribed voltage to a plurality of Y-electrodes Y1, Y2, . . . . Hereinafter, each of the Y-electrodes Y1, Y2, . . . , or the generic of the Y-electrodes is referred to as a Y-electrode Yi, where "i" means a subscript. The address electrode driving circuit 6 supplies a prescribed voltage to a plurality of address electrodes A1, A2, . . . . Hereinafter, each of the address electrodes A1, A2, . . . , or the generic of the address electrodes is referred to as an address electrode Aj, where "j" means a subscript.

In a plasma display panel 3, the Y-electrode Yi and the X-electrode Xi form lines extending in the horizontal direction in parallel, and the address electrode Aj forms a row extending in the vertical direction. The Y-electrode Yi and the X-electrode Xi are arranged alternately in the vertical direction. The Y-electrode Yi and the address electrode Aj form two dimensional lines of an i-line and a j-row. A display cell Cij is formed with an intersection point of the Y-electrode Yi and the address electrode Aj, and the adjacent X-electrode Xi corresponding to the above intersection point. The display cell Cij corresponds to a pixel and the plasma display panel 3 can display a two-dimensional image.

Figure 6:
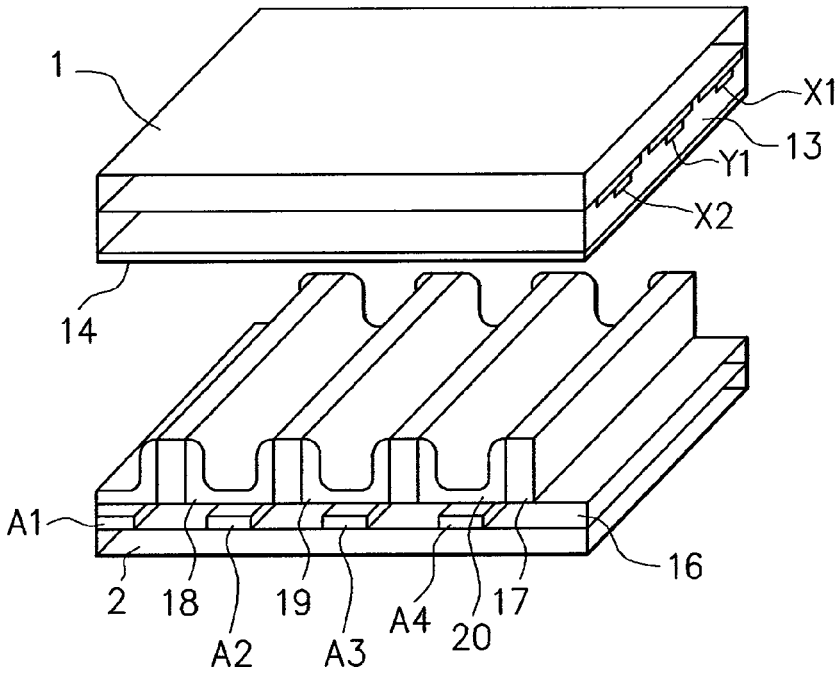
FIG. 6 is an exploded perspective view of a configuration example of a plasma display panel.

FIG. 6 is an exploded perspective view depicting a configuration example of the plasma display panel 3. The X-electrode Xi and the Y-electrode Yi are formed above a front glass substrate 1. Above the glass substrate 1, a dielectric layer 13 to insulate from a discharge space is adhered. Further above the dielectric layer 13, a magnesium oxide (MgO) protective layer 14 is adhered. While the address electrode Aj is formed above a rear glass substrate 2 opposedly disposed to the front glass substrate 1. Above the rear glass substrate 2, a dielectric layer 16 is adhered. Further above the dielectric layer 16, phosphors 18 to 20 are adhered. On the inside surface of a partition wall 17, red, blue and green phosphors 18 to 20 are arranged and coated in each color in a stripe. By electrical discharging between the X-electrode Xi and the Y-electrode Yi, the phosphors 18 to 20 are excited, and light in respective colors are emitted. In the discharge space between the front glass substrate 1 and the rear glass substrate 2, Penning gas of neon+xenon (Ne+Xe) or the like is enclosed.

Figure 7:
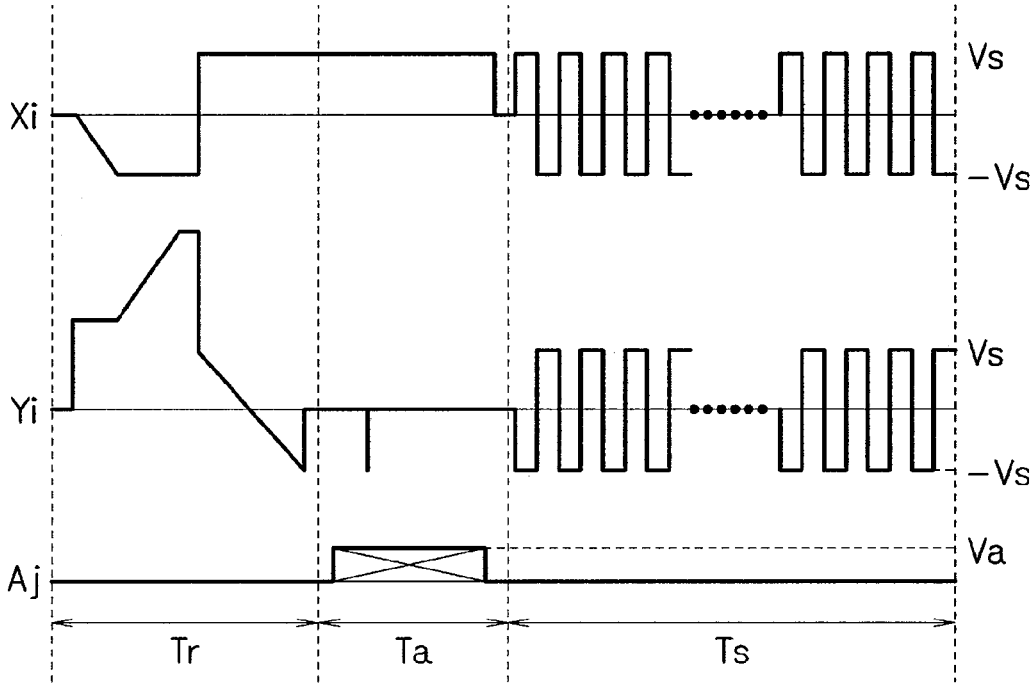
FIG. 7 is a timing chart for explaining an operation example during a reset period, an address period and a sustain period of the plasma display device.

FIG. 7 is a timing chart to explain an operation example during a reset period Tr, an address period Ta and a sustain period Ts of the plasma display device. During the reset period Tr, a prescribed voltage is applied to the X-electrode Xi and the Y-electrode Yi to initialize the display cell Cij.

During the address period Ta, scan pulses are sequentially scanned and applied to the Y-electrodes Y1, Y2, . . . , and a display pixel is selected by applying an address pulse to the address electrode Aj in accordance with the scan pulse. When the address pulse of the address electrode Aj is generated in accordance with the scan pulse of the Y-electrode Yi, the display cell of the Y-electrode Yi and the X-electrode Xi is selected. If the address pulse of the address electrode Aj in accordance with the scan pulse of the Y-electrode Yi is not generated, the display cell of the Y-electrode Yi and the X-electrode Xi is not selected. When the address pulse is generated in accordance with the scan pulse, an address discharge occurs between the address electrode Aj and the Y-electrode Yi, which causes an electric discharge between the X-electrode Xi and the Y-electrode Yi using the address discharge as a pilot frame. Then, a negative charge is accumulated on the X-electrode Xi and a positive charge is accumulated on the Y-electrode Yi. The Y-electrode driving circuit 5 includes a scan driving circuit supplying a scan pulse to the Y-electrode Y1, Y2, . . . .

During the sustain period Ts, sustain pulses in mutually reverse phases are applied to the X-electrode Xi and the Y-electrode Yi, and a sustain discharge is conducted between the X-electrode Xi and the Y-electrode Yi of the selected display cell to emit light. The X-electrode driving circuit 4 includes a sustain driving circuit generating the sustain pulse of the X-electrode Xi to conduct the sustain discharge between the X-electrode Xi and the Y-electrode Yi, and supplying it to the X-electrode Xi. The Y-electrode driving circuit 5 includes a sustain driving circuit generating the sustain pulse of the Y-electrode Yi to conduct the sustain discharge between the X-electrode Xi and the Y-electrode Yi, and supplying it to the Y-electrode Yi.

Figure 8:
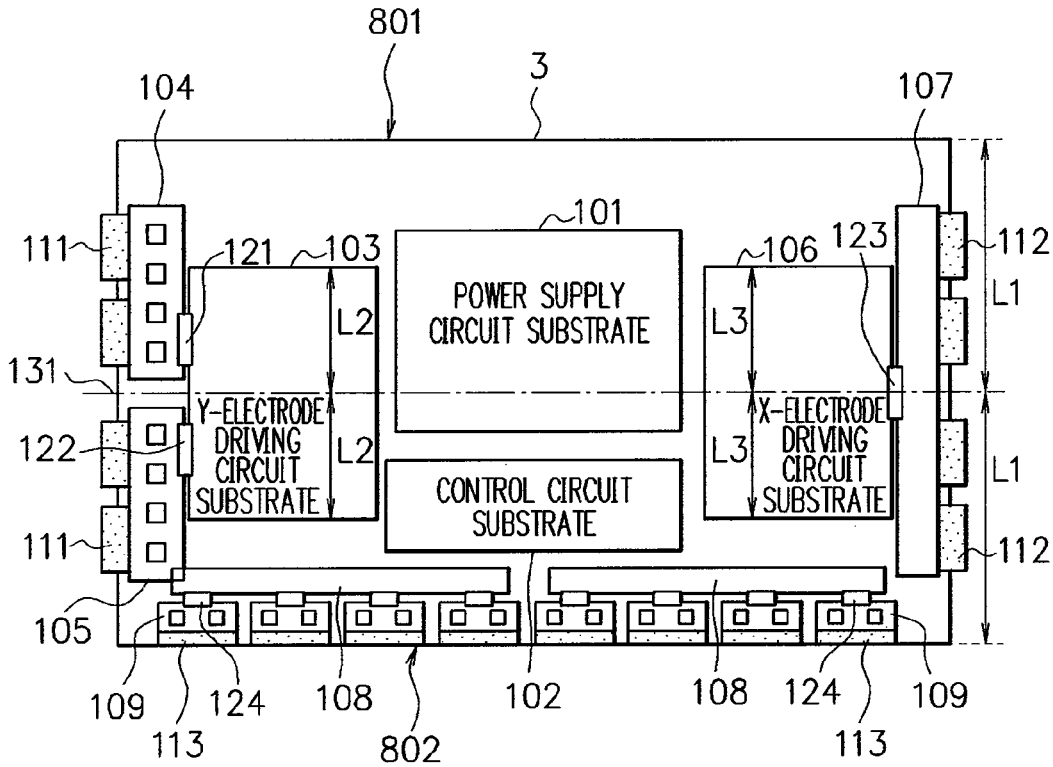
FIG. 8 is a view of a mounting example of a typical plasma display device.

FIG. 8 is a view depicting a mounting example of a typical plasma display device. Above the rear surface of the plasma display panel 3, a power supply circuit substrate 101, a control circuit substrate 102, a Y-electrode driving circuit substrate 103, scan driving circuit substrates 104 and 105, an X-electrode driving circuit substrate 106, an X-electrode relay substrate 107, an address electrode relay substrate 108 and an address electrode driving circuit substrate 109 are mounted via a chassis.

The power supply circuit substrate 101 supplies electric power to circuits in the plasma display device. The control circuit substrate 102 is a substrate that mounts the control circuit 7 in FIG. 5.

The Y-electrode driving circuit substrate 103 is a substrate that mounts the sustain driving circuit in the Y-electrode driving circuit 5 in FIG. 5. The sustain driving circuit in the Y-electrode driving circuit 5 generates the sustain pulse of the Y-electrode Yi to conduct the sustain discharge between the X electrode Xi and the Y-electrode Yi during the sustain period Ts in FIG. 7, which is supplied to the Y-electrode Yi.

The scan driving circuit substrates 104 and 105 are substrates that mount the scan driving circuit in the Y-electrode driving circuit 5 in FIG. 5. The scan driving circuit in the Y-electrode driving circuit 5 generates the scan pulse during the address period Ta in FIG. 7 and supplies the scan pulse to the Y-electrode Yi. The scan driving circuit substrate 104 is connected to the Y-electrode driving circuit substrate 103 via a connector 121. The scan driving circuit substrate 105 is connected to the Y-electrode driving circuit substrate 103 via a connector 122. The scan driving circuit substrates 104 and 105 are connected to the Y-electrode Yi of the plasma display panel 3 via flexible cable 111.

The X-electrode driving circuit substrate 106 is a substrate that mounts the X-electrode driving circuit (including the sustain driving circuit) 4 in FIG. 5. The sustain driving circuit of the X-electrode driving circuit 4 generates the sustain pulse of the X-electrode Xi to conduct the sustain discharge between the X-electrode Xi and the Y-electrode Yi during the sustain period Ts in FIG. 7, and supplies the sustain pulse to the X-electrode Xi.

The X-electrode driving circuit substrate 106 is connected to the X-electrode relay substrate 107 via a connector 123. The X-electrode relay substrate 107 is connected to the X-electrode Xi of the plasma display panel 3 via flexible cables 112.

The address electrode relay substrate 108 is connected to an address electrode driving circuit substrate 109 via a connector 124. The address electrode driving circuit substrate 109 is a substrate which mounts the address electrode driving circuit 6 in FIG. 5, and is connected to the address electrode Aj of the plasma display panel 3 via flexible cables 113.

A center line 131 is a center line in the vertical direction of the plasma display panel 3, and the height L1 from the upper end and the height L1 from the lower end are the same. All the X-electrodes Xi of the plasma display panel 3 are connected to the X-electrode driving circuit substrate 106 via the flexible cables 112. Accordingly, the center line in the vertical direction of the X electrode driving circuit substrate 106 is the same as the center line 131 in the vertical direction of the plasma display panel 3. The center line 131 in the vertical direction of the X-electrode driving circuit substrate 106 has the same height between the height L3 from the upper end to the center line and the height L3 from the lower end to the center line.

Similarly, all the Y-electrodes Yi of the plasma display panel 3 are connected to the Y-electrode driving circuit substrate 103 via the flexible cables 111. Accordingly, the center line in the vertical direction of the Y-electrode driving circuit substrate 103 is the same as the center line 131 in the vertical direction of the plasma display panel 3. The center line 131 in the vertical direction of the Y-electrode driving circuit substrate 103 has the same height between the height L2 from the upper end to the center line and the height L2 from the lower end to the center line.

In the plasma display device, heat is generated from the plasma display panel 3 and from circuit substrates. A chimney effect of the heat causes a convection current. A hot air goes up and a cool air goes down. As a result, the temperature in the vicinity of an upper end 801 of the plasma display device rises, and the temperature in the vicinity of a lower end 802 falls.

The X-electrode driving circuit substrate 106 and the Y-electrode driving circuit substrate 103 are high in temperature at the upper parts thereof and low in temperature at the lower parts thereof. The upper parts of the X-electrode driving circuit substrate 106 and the Y-electrode driving circuit substrate 103 are high in temperature, which makes the electronic parts thereof be liable to deteriorate. In particular, the life of a capacitor is shortened. Hereinafter, in the present embodiment, a method of preventing the deterioration of the electronic parts in the X-electrode driving circuit substrate 106 and the Y-electrode driving circuit substrate 103 will be explained.

Figure 1:
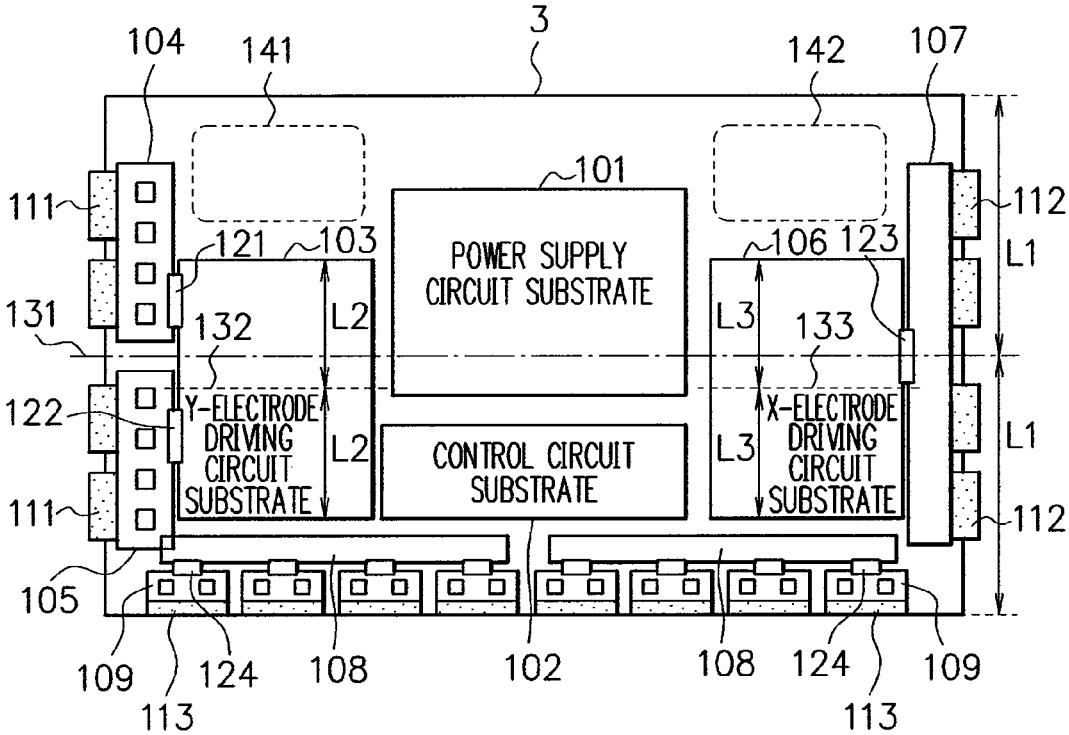
FIG. 1 is a view of a mounting example of a plasma display device according to an embodiment of the present invention.

FIG. 1 is a view depicting a mounting example of the plasma display device according to the present embodiment. Points where the plasma display device of the present embodiment differs from the plasma display device in FIG. 8 will be explained below. As for the other points, the plasma display device of the present embodiment is the same as the plasma display device in FIG. 8.

The X-electrode driving circuit substrate 106 is a circuit substrate supplying voltage to the X-electrode Xi. In concrete, it is a sustain driving circuit substrate generating a sustain pulse of the X-electrode Xi to conduct the sustain discharge between the X-electrode Xi and the Y-electrode Yi and supplying to the X-electrode Xi.

The Y-electrode driving circuit substrate 103 is a circuit substrate to supply voltage to the Y-electrode Yi. In concrete, the Y-electrode driving circuit substrate 103 is a sustain driving circuit substrate generating a sustain pulse of the Y-electrode Yi to conduct the sustain discharge between the X-electrode Xi and the Y-electrode Yi and supplying to the Y-electrode Yi.

The center line 131 is a center line in the vertical direction of the plasma display panel 3, and the height L1 from the upper end and the height L1 from the lower end are the same. In a center line 133 in the vertical direction of the X-electrode driving circuit substrate 106, the height L3 from the upper end and the height L3 from the lower end are the same. In a center line 132 in the vertical direction of the Y-electrode driving circuit substrate 103, the height L2 from the upper end and the height L2 from the lower end are the same.

The center line 133 in the vertical direction of the X-electrode driving circuit substrate 106 is below the center line 131 in the vertical direction of the plasma display panel 3. Further, the distance from the upper end of the X-electrode driving circuit substrate 106 to the upper end of the plasma display panel 3 is longer than the distance from the lower end of the X-electrode driving circuit substrate 106 to the lower end of the plasma display panel 3. By disposing the X-electrode driving circuit substrate 106 at a lower part of the plasma display panel 3, a space 142 is created above the X-electrode driving circuit substrate 106. The space 142 is a part having high temperatures due to the chimney effect. By disposing the X-electrode driving circuit substrate 106 below the high-temperature space 142, it is possible to dispose the X-electrode drive circuit substrate 106 in a relatively low temperature area. As a result, it is possible to prevent deterioration of electronic parts (capacitors, for instance) in the X-electrode driving circuit substrate 106 and to lengthen the life of the devices.

Further, the center line 132 in the vertical direction of the Y-electrode driving circuit substrate 103 is below the center line 131 in the vertical direction of the plasma display panel 3. In addition, the distance from the upper end of the Y-electrode driving circuit substrate 103 to the upper end of the plasma display panel 3 is longer than the distance from the lower end of the Y-electrode driving circuit substrate 103 to the lower end of the plasma display panel 3. By disposing the Y-electrode driving circuit substrate 103 at a lower part of the plasma display panel 3, a space 141 is created above the Y-electrode driving circuit substrate 103. The space 141 is a part having high temperatures due to the chimney effect. By disposing the Y-electrode driving circuit substrate 103 below the high-temperature space 141, it is possible to dispose the Y-electrode drive circuit substrate 103 in a relatively low temperature area. As a result, it is possible to lengthen the life of electronic parts (capacitors, for instance) in the Y-electrode driving circuit substrate 103.

Figure 2:
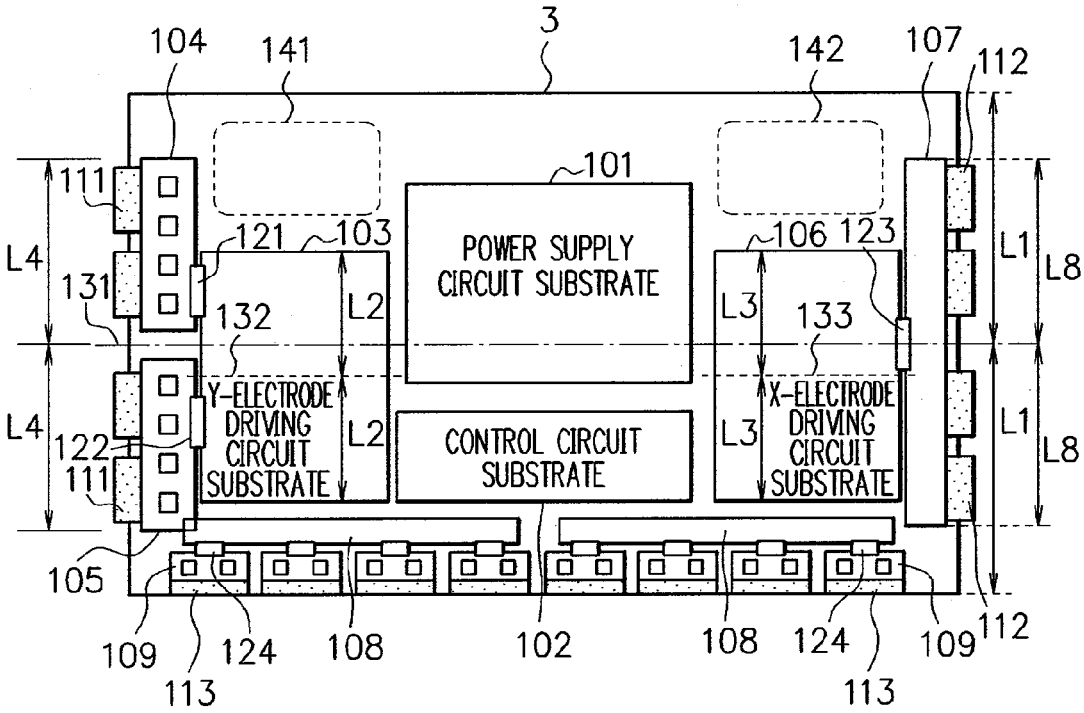
FIG. 2 is a view explaining a mounting position of an X-electrode relay substrate and a scan driving circuit substrate.

FIG. 2 depicts a mounting structure the same as that of the plasma display device depicted in FIG. 1, and is a figure to explain mounting positions of the X-electrode relay substrate 107 and the scan driving circuit substrates 104, 105.

The X-electrode drive circuit substrate 106 is connected to the X-electrode relay substrate 107 via the connector 123. The X-electrode relay substrate 107 is connected to the X-electrode Xi of the plasma display panel 3 via the flexible cables 112.

The X-electrode relay substrate 107 is provided between the X-electrode Xi and the X-electrode driving circuit substrate 106. All the X-electrodes Xi of the plasma display panel 3 are connected to the X-electrode relay substrate 107 via the flexible cables 112. Accordingly, the X-electrode relay substrate 107 is provided at a position symmetric to the center line 131 in the vertical direction of the plasma display panel 3, and the height L8 from the center line 131 to the upper end and the height L8 from the center line 131 to the lower end are the same.

The scan driving circuit substrate 104 is connected to the Y-electrode driving circuit substrate 103 via the connector 121. The scan driving circuit substrate 105 is connected to the Y-electrode driving circuit substrate 103 via the connector 122. The scan driving circuit substrates 104 and 105 are connected to the Y-electrodes Yi of the plasma display panel 3 via the flexible cables 111.

The scan driving circuit substrates 104 and 105 are provided between the Y-electrode Yi and the Y-electrode driving circuit substrate 103, and generate the scan pulse during the address period Ta in FIG. 7 to supply to all the Y-electrodes Yi in sequence. All the Y-electrodes Yi of the plasma display panel 3 are connected to the scan driving circuit substrates 104 and 105 via the flexible cables 111. Accordingly, the scan driving circuit substrates 104 and 105 are provided at positions symmetric to the center line 131 in the vertical direction of the plasma display panel 3, and the height L4 from the center line 131 to the upper end and the height L4 from the center line 131 to the lower end are the same. Note that the number of the scan driving circuit substrates 104 and 105 is not limited to two, it may be one, or three or more.

Figure 3:
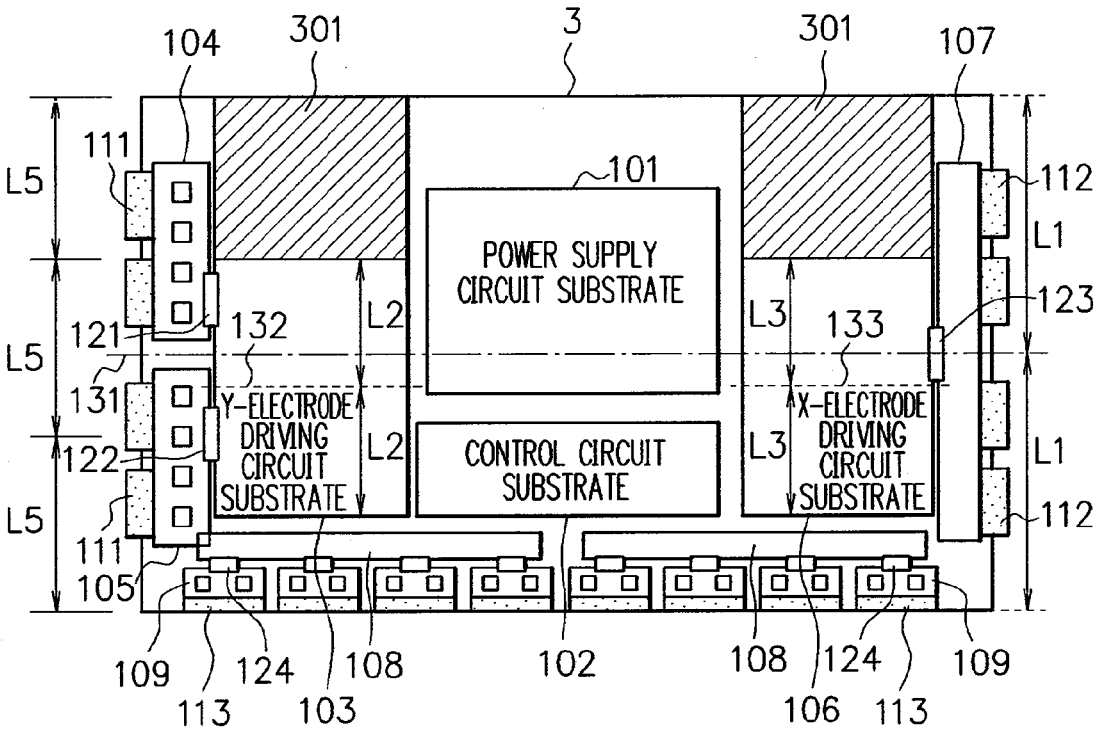
FIG. 3 is a view explaining a mounting position of an X-electrode driving circuit substrate and a Y-electrode driving circuit substrate.

FIG. 3 depicts a mounting structure the same as that of the plasma display device depicted in FIG. 1, and is a figure to explain mounting positions of the X-electrode driving circuit substrate 106 and the Y-electrode driving circuit substrate 103. The height of the plasma display device 3 in the vertical direction is "3×L5". An area 301 is the area positioning at a position of ⅓from the top in the vertical direction of the plasma display panel 3. The X-electrode driving circuit substrate 106 and the Y-electrode driving circuit substrate 103 are disposed in an area within ⅔from the bottom in the vertical direction of the plasma display panel 3, and are not disposed within the area 301.

Figure 4:
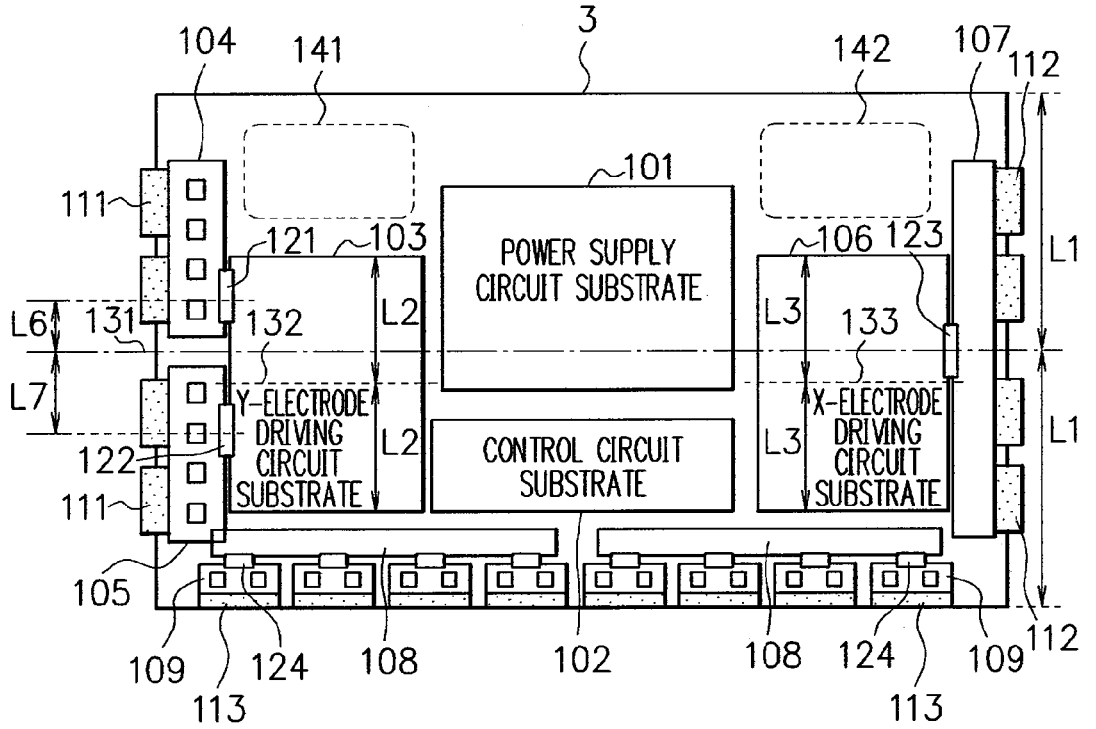
FIG. 4 is a view explaining a mounting position of a connector.

FIG. 4 depicts a mounting structure the same as the plasma display device depicted in FIG. 1 and is a view to explain mounting positions of the connectors 121 to 123. The connector 121 connects the Y-electrode driving circuit substrate 103 and the scan driving circuit substrate 104. As for the center line in the vertical direction of the connector 121, the height from the center line 131 in the vertical direction of the plasma display panel 3 is L6. The connector 122 connects the Y-electrode driving circuit substrate 103 and the scan driving circuit substrate 105. As for the center line in the vertical direction of the connector 122, the height from the center line 131 in the vertical direction of the plasma display panel 3 is L7. The height L6 is lower than the height L7. The connectors 121 and 122 are provided at positions asymmetrical to the center line 131 in the vertical direction of the plasma display panel 3. Note that an example of providing two pieces each of the scan driving circuit substrates 104, 105 and the connectors 121, 122 is depicted, but it is also possible to provide one piece, three pieces or more.

The connector 123 connects the X-electrode driving circuit substrate 106 and the X-electrode relay substrate 107. The center line in the vertical direction of the connector 123 is the same as the center line 131 in the vertical direction of the plasma display panel 3. The connector 123 is provided at a position symmetric to the center line 131 in the vertical direction of the plasma display panel 3. Note that an example of providing one piece each of the X-electrode relay substrate 107 and the connector 123, is depicted, but two pieces or more may be provided respectively.

As described above, according to the present embodiment, the X-electrode driving circuit substrate 106 and the Y-electrode driving circuit substrate 103 are disposed below the center line 131 in the vertical direction of the plasma display panel 3. Owing to this configuration, it is possible to avoid areas 141 and 142 where the temperature of the plasma display device is high, and to dispose the X-electrode driving circuit substrate 106 and the Y-electrode driving circuit substrate 103 in a space where the temperature is low. As a result, it is possible to prevent deterioration of electronic parts in the X-electrode driving circuit substrate 106 and the Y-electrode driving circuit substrate 103, to easily enhance heat radiation efficiency of the plasma display device and to realize downsizing of radiators and substrates.

All the above-described embodiments only depict examples of actualizing the present invention at the time of performing thereof, and its technical aspect should not be considered as limitative by the above embodiments. In other words, the present invention may be implemented in other specific forms without departing from the technical idea or the essential characteristics thereof.

INDUSTRIAL APPLICABILITY

Since plasma display devices are high in temperature at the upper part and low in temperature at the lower part, it is possible to dispose an electrode driving circuit substrates in a low temperature area. Owing to this configuration, it is possible to prevent deterioration of electronic parts in the electrode driving circuit substrates.

What is claimed is:

1. A plasma display device, comprising:

a plasma display panel comprising a plurality of first and second electrodes extending in the horizontal direction, and a plurality of third electrodes extending in the vertical direction;

a first electrode driving circuit substrate to supply to the first electrodes a sustain pulse to conduct a sustain discharge between the first and the second electrodes; and a first substrate provided between the first electrodes and said first electrode driving circuit substrate, wherein:

the first substrate is disposed adjacent at one end portion side of said first electrode driving circuit substrate in the horizontal direction of said plasma display panel, and a center line in the vertical direction of said first electrode driving circuit substrate is shifted below a center line in the vertical direction of said first substrate and said plasma display panel.

2. The plasma display device according to claim 1, further comprising:

a second electrode driving circuit substrate to supply the sustain pulse to the second electrodes, and a second substrate provided between the second electrodes and said second electrode driving circuit substrate, wherein:

the second substrate is disposed at or near the other end in the horizontal direction of said plasma display panel, and a center line in the vertical direction of said second electrode driving circuit substrate is shifted below a center line in the vertical direction of said second substrate.

3. The plasma display device according to claim 2, wherein:

the first substrate is a scan driving circuit substrate supplying a scan pulse to the plurality of first electrodes; and the second substrate is a relay substrate.

4. The plasma display device according to claim 2, wherein said first and said second electrode driving circuit substrates are provided in an area within ⅔ from the bottom in the vertical direction of said plasma display panel, to make a vacant space in an area above said first electrode driving circuit substrate and at a position of ⅓ from the top in the vertical direction of said plasma display panel.

5. The plasma display device according to claim 2, further comprising:

a first connector to connect said first electrode driving circuit substrate and the first substrate; and a second connector to connect said second electrode driving circuit substrate and the second substrate, wherein:

the first connector includes a plurality of connectors, a halfway line between a top end of the uppermost-disposed connector and a bottom end of the lowermost-disposed connector is shifted to the side of the center line in the vertical direction of said first substrate from the center line in the vertical direction of said first electrode driving circuit substrate, and the second connector is provided at a position symmetric to the center line in the vertical direction of said first electrode driving circuit substrate.

6. The plasma display device according to claim 1, wherein said first electrode driving circuit substrate is provided in an area within ⅔ from the bottom in the vertical direction of said plasma display panel, to make a vacant space in an area above said first electrode driving circuit substrate and within ⅓ from the top in the vertical direction of said plasma display panel.

7. The plasma display device according to claim 1, further comprising:

a first connector to connect said first electrode driving circuit substrate and the first substrate, wherein:

said first connector includes a plurality of connectors, and a halfway line between a top end of the uppermost-disposed connector and a bottom end of the lowermost-disposed connector is shifted to the side of the center line in the vertical direction of said first substrate from the center line in the vertical direction of said first electrode driving circuit substrate.

8. A plasma display device, comprising:

a plasma display panel comprising a plurality of first and second electrodes extending in the horizontal direction and a plurality of third electrodes extending in the vertical direction;

a first electrode driving circuit substrate to supply to the first electrodes a sustain pulse to conduct a sustain discharge between the first and the second electrodes;

a first substrate provided between the first electrodes and said first electrode driving circuit substrate, supplying a scan pulse to each of the plurality of first electrodes; and a first connector to connect said first electrode driving circuit substrate and the first substrate, wherein:

the distance from the upper end of said first electrode driving circuit substrate to the upper end of said first plasma display panel is longer than the distance from the lower end of said first electrode driving circuit substrate to the lower end of said plasma display panel, the first substrate is disposed adjacent at one end portion side of said first electrode driving circuit substrate in the horizontal direction of said plasma display panel, the distance from the upper end of the first substrate to the center line in the vertical direction of said plasma display panel is equal to the distance from the lower end of the first substrate to the center line in the vertical direction of said plasma display panel, the first connector includes a plurality of connectors, and the distance from a center line in the vertical direction of the uppermost-disposed connector to the center line in the vertical direction of said plasma display panel is shorter than the distance from a center line in the vertical direction of the lowermost-disposed connector to the center line in the vertical direction of said plasma display panel.

* * * * *